US007258143B2

(12) United States Patent
Phipps et al.

(10) Patent No.: US 7,258,143 B2
(45) Date of Patent: Aug. 21, 2007

(54) SYSTEM AND METHOD FOR REGULATING THE VOLUME OF BARRIER FLUID IN A LIQUID RING VACUUM PUMP

(75) Inventors: John Mark Edward Phipps, Glouchestershire (GB); Nadim Tahir, Rotherham (GB)

(73) Assignee: AES Engineering Ltd., Rotherham (GB)

( * ) Notice: Subject to any disclaimer, the term of this patent is extended or adjusted under 35 U.S.C. 154(b) by 111 days.

(21) Appl. No.: 10/939,123

(22) Filed: Sep. 10, 2004

(65) Prior Publication Data

US 2005/0081952 A1 Apr. 21, 2005

(51) Int. Cl.
*B65B 1/04* (2006.01)

(52) U.S. Cl. ..... 141/198; 141/95; 222/54

(58) Field of Classification Search ..... 141/95, 141/98, 198, 301, 302, 82; 222/54, 67
See application file for complete search history.

(56) References Cited

U.S. PATENT DOCUMENTS 4,601,409 A * 7/1986 DiRegolo ..... 222/1
5,086,731 A * 2/1992 Lockett et al. ..... 126/351.1
5,141,131 A * 8/1992 Miller et al. ..... 222/54
5,462,669 A * 10/1995 Yeh ..... 210/703
5,605,445 A 2/1997 Trimborn ..... 417/68
6,012,481 A * 1/2000 Lenart ..... 137/426

FOREIGN PATENT DOCUMENTS

EP 0 246 782 A3 11/1987
GB 876314 8/1961
JP 62243981 A 10/1987

OTHER PUBLICATIONS

Search and Examination Report for Great Britain Application No. GB0420046.5, dated Dec. 20, 2004.

* cited by examiner

*Primary Examiner*—Steven O. Douglas
(74) *Attorney, Agent, or Firm*—Myers Bigel Sibley & Sajovec, PA

(57) ABSTRACT

In a system and method for ensuring that a liquid ring vacuum pump contains an optimum amount of barrier fluid the pump and a vessel for containing barrier fluid are set at respective levels such that, when the pump is at rest and the level of barrier fluid id at its optimum the level of the fluid in the vessel is at a convenient and pre-selected level with respect to the height of the vessel. In operation of the pump, if the level of the barrier fluid in the vessel departs from the pre-selected level as detected by detecting means, the vessel is automatically charge with barrier fluid from a barrier fluid supply, or barrier fluid is automatically discharged from the vessel, as appropriate. The correct level or quantity of barrier fluid in the pump is thereby maintained.

31 Claims, 6 Drawing Sheets

SYSTEM AND METHOD FOR REGULATING THE VOLUME OF BARRIER FLUID IN A LIQUID RING VACUUM PUMP

RELATED APPLICATIONS

This application claims priority to U.K. Application No. 0321455.8 filed Sep. 12, 2003, the disclosure of which is hereby incorporated by reference in its entirety.

FIELD OF THE INVENTION

This invention relates to a system and method for regulating the volume of barrier fluid in liquid ring vacuum pumps.

BACKGROUND OF THE INVENTION

Liquid ring vacuum pumps are suitable for moving fluids. Such fluids will be referred to as "working fluids" throughout the description. The fluid may be a liquid fluid and/or a gaseous fluid. Liquid ring vacuum pumps are commonly used to transfer working fluids in drug, food and plastic extrusion plants. For example, a vacuum pump may be used to evacuate working fluid that has been used to cool hot extruded plastic. In this particular example, the extracted fluid is usually a mixture of air and water. A liquid ring vacuum pump is depicted in FIGS. 1 and 2. FIG. 1 depicts a stationary pump and FIG. 2 depicts a pump in operation. The pump (1) includes a housing (2), which is partially filled with a barrier fluid (3). A multi-bladed impeller (4) is mounted on a shaft (5). The shaft is arranged off-centre from the central axis of the housing (2) such that the impeller is positioned eccentrically. Port plates (not shown) are arranged on either side of the impeller (not shown) forming an inlet and outlet into the housing. Thus, one side of the pump is known as the inlet port side and the other side of the pump is known as the outlet port side. As the impeller rotates a centrifugal force pushes the barrier fluid towards the periphery of the housing. A ring (6) of barrier fluid is formed around the inner wall of the pumping chamber with a constant width and depth. Since the impeller (4) is mounted eccentrically, the depths to which the blades penetrate the liquid ring (6) vary as the impeller (4) rotates. It can be seen in FIG. 2 that the depth of penetration of any given blade of the impeller (4) decreases as the blade rotates from an upper position indicated at (A) to lower position indicated at (B). This leads to an increase in the impeller cell volume (the space formed between the liquid ring and root of the blade) that in turn leads to the creation of a vacuum. Meanwhile, the depth of penetration increases as the blades rotate from the lower position to the upper position. Thus, the impeller cell volume decreases and so pressure increases. In operation, the vacuum draws working fluid in through the inlet and into the cavity formed between the root of the impeller blade and inside diameter of the liquid ring and the high pressure region subsequently discharges the working fluid through the outlet.

The barrier fluid is an essential component of a liquid ring vacuum pump. The barrier fluid is required to lubricate the pump, help create a vacuum so that working fluids are drawn into the pump, help create a high pressure region in order to discharge working fluids from the pump and also cool the pump.

The barrier fluid of a liquid ring vacuum pump includes at least one liquid fluid and optionally at least one gaseous fluid. Water is typically used as a barrier fluid. However, other suitable liquids may be used as an alternative.

During operation, barrier fluid is also drawn into the vacuum pump through the inlet and discharged through the outlet. The volume of barrier liquid drawn into the pump is generally equal to the volume of barrier fluid discharged from the pump. The discharged evacuated fluid may be separated from the discharged barrier fluid. It is imperative that the liquid ring vacuum pump operates using the correct amount of barrier fluid. The correct quantity of barrier fluid may vary between different designs of pumps but, for many common pump designs, when the pump is stationary, the volume of barrier fluid should be such that the barrier fluid level reaches the centre line of the pump. Again, the exact level may vary between different pump designs: in some pumps the barrier fluid level is just above the centre line of the pump and in other pump designed it may be just below. Thus for any given pump design there is a predetermined optimum fill level for the barrier fluid which is required for efficient operation of the pump. If the pump has too much barrier fluid then it will seek to compress the incompressible fluids. This may cause the blades of the impeller to bend and possibly break. Pump failure may also occur if the pump has too little fluid. The pump will be unable to create a vacuum, the pump may run dry or cavitation may occur which may subsequently cause damage to the internal structure of the pump.

Unfortunately, the volume of barrier fluid within the pump may vary. The volume of barrier fluid may vary gradually over time or change suddenly due a process upset. For example, barrier fluid may leak from the pump. Barrier fluid may evaporate if it becomes too hot. Also, sudden changes in temperature and/or pressure may result in either a loss or increase in barrier fluid. Thus, a system for controlling the volume of barrier fluid in a liquid ring vacuum pump is required.

A known system for regulating the volume of barrier fluid in a liquid ring vacuum pump is depicted in FIG. 3. The system includes a chamber (7) containing a quantity 7' of barrier fluid. The chamber (7) is connected to the inlet (1A) and outlet (1B) of the pump (1). Thus, barrier fluid is discharged from the pump into the chamber and drawn from the chamber into the pump. A return valve (8) ensures that barrier fluid cannot leave the pump (1) from the wrong exit (9). The chamber (7) is also connected to a barrier fluid source (11) in order to replenish any barrier fluid that is lost due to leaks, evaporation and/or process upsets. The replenishing source of barrier fluid is controlled by a regulating valve (11A). The chamber (7) is connected to an outlet (12) that enables any excess barrier fluid to drain away. Any gas discharged into the chamber (7) is released through a vent (10). A shell and tube heat exchanger (13) is arranged between the chamber (7) and pump (1) in order to cool the barrier fluid prior to re-entry into the pump (1). The heat exchanger (13) uses cooling liquid (14) to help cool the barrier fluid. A return valve (15) is arranged to control the re-entry of barrier fluid into the vacuum pump (1).

The regulating valve (11A) for the barrier fluid source is manually controlled. Thus, the barrier fluid is replenished using trial and error and this often leads to an over-supply or under-supply of barrier fluid in the vacuum pump (1). A manually controlled valve is also prone to human error. Furthermore, the regulating valve (11A) requires continual adjustment whilst the pump (1) is in operation. Therefore, the pump (1) has a high risk of failing. Typically, adjustment of the barrier fluid is reliant on the judgement of an experienced operator who can judge from, for example, the sound of the pump whether replenishment of the barrier fluid is necessary. Visual inspection of the level of barrier fluid in the vessel (7) is not carried out for determining whether the quantity of barrier fluid contained in the system is correct.

As explained above, it is essential that the pump (1) has the correct volume of barrier fluid. Therefore, a more accurate means and method of adjusting the volume of barrier fluid is required. In the prior art this has been achieved by adding a flow indicator to the regulating valve (11A) and adding a flow indicator to the outlet (1B) from the pump (1). The flow indicators electronically detect and control the flow of fluid. The flow indicators are centrally controlled such that the flow of barrier fluid from the source (11) is adjusted in accordance with the flow of barrier fluid from the outlet of the pump (1B). However, this solution is costly and difficult to implement, it unduly increases the complexity of the system and produces a system that is both costly and difficult to maintain. Therefore, an accurate, relatively simple and relatively cheap means and method of regulating the volume of barrier fluid in a liquid ring vacuum pump is required.

SUMMARY

A first aspect of the invention relates to a system for regulating the volume of barrier fluid in a liquid ring vacuum pump comprising a vessel for containing barrier fluid, feeding means for feeding barrier fluid between a vessel and a pump, whereby the vessel is arranged with respect to a pump such that the level of barrier fluid in the vessel is indicative of the level of barrier fluid in the pump; detecting means for automatically detecting the level of barrier fluid in the vessel; and restoring means for automatically restoring the level of barrier fluid in the vessel, and consequently the pump, to a predetermined level if the level of barrier fluid detected by the detecting means does not correspond to the predetermined level.

The restoring means may comprise means for supplying barrier fluid from a barrier fluid source to the vessel when the barrier fluid level in the vessel is below the predetermined level. The means for supplying barrier fluid preferably comprise inlet means for feeding barrier fluid from the barrier fluid source to the vessel and a valve for automatically controlling the supply of barrier fluid from the barrier fluid source in response to the level of barrier fluid detected by the detecting means.

Preferably, the detecting means and valve for controlling the supply of barrier fluid are interconnected mechanical devices. For example, the detecting means may comprise a float and the valve for controlling the supply of barrier fluid may comprise a ball-cock valve. Alternatively, the detecting means and valve for controlling the supply of barrier fluid are interconnected electrical or electro-mechanical devices.

The means for restoring the level of barrier fluid may optionally comprise means for discharging barrier fluid from the vessel when the barrier fluid level in the vessel exceeds the predetermined level. Preferably, the means for discharging barrier fluid comprise outlet means for discharging barrier fluid from the vessel. Furthermore, the means for discharging barrier fluid may also comprises a valve for automatically controlling the discharge of barrier fluid through the outlet means in response to the level of barrier fluid detected by the detecting means.

The detecting means and valve for controlling the discharge of barrier fluid may be interconnected mechanical devices or interconnected electrical devices.

Typically, the system comprises a heat exchanger for cooling the barrier fluid.

The system may also comprise thermostatically controlled outlet means for discharging barrier fluid from the vessel when the temperature of the barrier fluid exceeds a predetermined temperature.

Preferably, the system comprises a sediment trap for removing sediment from the barrier fluid.

The system may optionally comprise at least one vent for releasing gaseous fluids from the vessel.

The system may include at least one movable support to adjust the position of the vessel relative to the pump such that the level of barrier fluid in the vessel is indicative of the level of barrier fluid in the pump.

A second aspect of the invention relates to system for maintaining a desired quantity of barrier fluid in a liquid ring vacuum pump, comprising: a vessel for containing barrier fluid; and a barrier fluid flow path from the vessel to the pump and from the pump to the vessel; the vessel being arranged at a height with respect to the pump such that when the barrier fluid in the pump is at a predetermined optimum level corresponding to said desired quantity, the barrier fluid in the vessel is at a pre-selected level with respect to the vessel, the system further comprising: a detector operative to detect when the level of the barrier fluid in the vessel differs from said pre-selected level; and restoring means operative to supply barrier fluid from a barrier fluid source to the vessel when the barrier fluid level in the vessel is determined to be less than the pre-selected level and to discharge barrier fluid from the vessel when the barrier fluid level in the vessel is determined to be greater than the pre-selected level A third aspect of the invention relates to a system for maintaining a desired quantity of barrier fluid in a liquid ring vacuum pump, comprising: a liquid ring vacuum pump having an inlet port and an outlet port; a vessel for containing barrier fluid, the vessel having: an inlet port, an outlet port, a supply port operatively connected to a barrier fluid supply, a discharge port; a supply valve operable to control the supply of barrier fluid to the supply port and a discharge valve operable to control discharge of the barrier fluid through the discharge port; and a barrier fluid flow path from the outlet port of the vessel to the inlet port of the pump and from the outlet port of the pump to the inlet port of the vessel; the vessel being arranged at a height with respect to the pump such that when the barrier fluid in the pump is at a predetermined optimum level corresponding to said desired quantity, the barrier fluid in the vessel is at a pre-selected level with respect to the vessel, the system further comprising: a detector operative to detect when the level of the barrier fluid in the vessel differs from said pre-selected level; and restoring means operative to cause the supply valve to open when the barrier fluid level in the vessel is determined to be less than the pre-selected level, thereby to supply barrier fluid to the vessel through the supply port, and to cause the discharge valve to open when the barrier fluid level in the vessel is determined to be greater than the pre-selected level thereby to discharge barrier fluid from the vessel through the discharge port.

A fourth aspect of the invention relates to a method of regulating the volume of barrier fluid in a liquid ring vacuum pump comprising the steps of:

providing a vessel for holding barrier fluid;

providing feeding means for feeding barrier fluid between a vessel and a pump;

arranging the vessel with respect to the pump such that the level of barrier fluid in the vessel is indicative of the level of barrier fluid in the pump;

automatically detecting the level of barrier fluid in the vessel; and automatically restoring the level of barrier fluid in the vessel, and consequently the pump, to a predetermined level if the detected level of barrier fluid does not correspond to the predetermined level.

A fifth aspect of the invention relates to a method of regulating the volume of barrier fluid in a liquid ring vacuum pump using the system according to the first aspect of the invention, comprising the steps of:

automatically detecting the level of barrier fluid in the vessel; and automatically restoring the level of barrier fluid in the vessel, and consequently the pump, to a predetermined level if the detected level of barrier fluid does not correspond to the predetermined level.

A sixth aspect of the invention relates to a method of regulating the volume of barrier fluid in a liquid ring vacuum pump of an apparatus for moving fluid, the apparatus comprising:

a liquid ring vacuum pump;

a vessel for holding barrier fluid and arranged with respect to the pump such that the level of barrier fluid in the vessel is indicative of the level of barrier fluid in the pump;

feeding means for feeding barrier fluid between the vessel and pump, the method comprising the steps of:

automatically detecting the level of barrier fluid in the vessel; and automatically restoring the level of barrier fluid in the vessel, and consequently the pump, to a predetermined level if the detected level of barrier fluid does not correspond to the predetermined level.

A seventh aspect of the invention relates to an apparatus for moving fluids comprising a liquid ring vacuum pump and system for regulating the volume of barrier fluid in the liquid ring vacuum pump in accordance with the first aspect of the invention.

Embodiments of the present invention seek to counteract the problems suffered by prior art systems and methods. Embodiments of the invention seek to accurately regulate the volume of barrier fluid in a liquid ring vacuum pump. Embodiments of the invention overcome the risks associated in manually controlling the barrier fluid by automatically regulating the volume of barrier fluid in a liquid ring vacuum pump. Embodiments of the invention seek to regulate the volume of barrier fluid using a system that is generally simple and cheap and easy to maintain. Embodiments of the invention seek to regulate the volume of barrier fluid in a liquid ring vacuum pump using methods that are relatively simple and cheap.

BRIEF DESCRIPTION OF THE DRAWINGS

For a better understanding of the present invention and how it may be carried into effect, reference shall now be made, by way of example, to the accompanying drawings in which.

DETAILED DESCRIPTION OF EMBODIMENTS OF THE INVENTION

Figure 1:
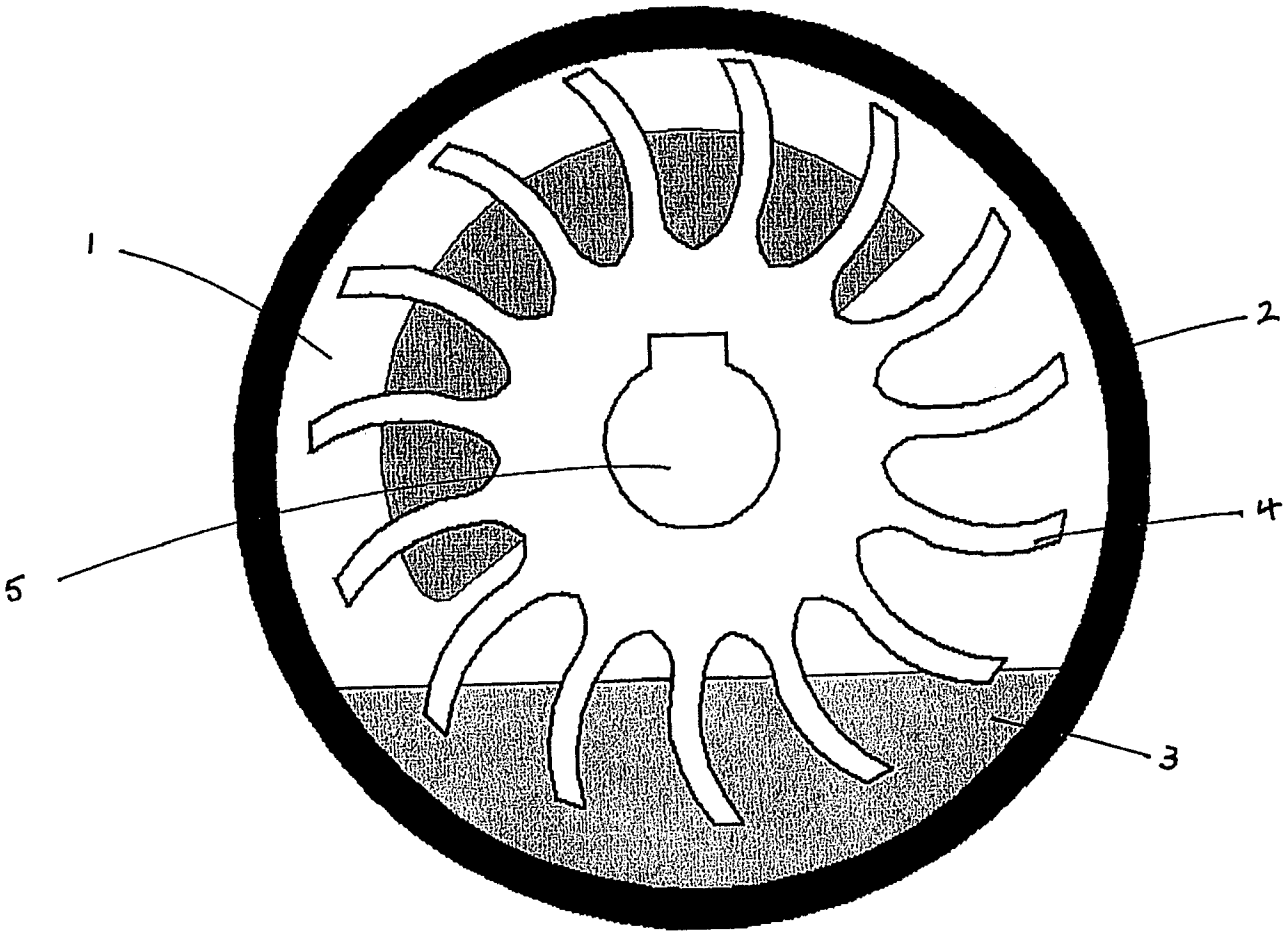
FIG. 1 depicts a cross-sectional view of a liquid ring vacuum pump at rest.
Figure 2:
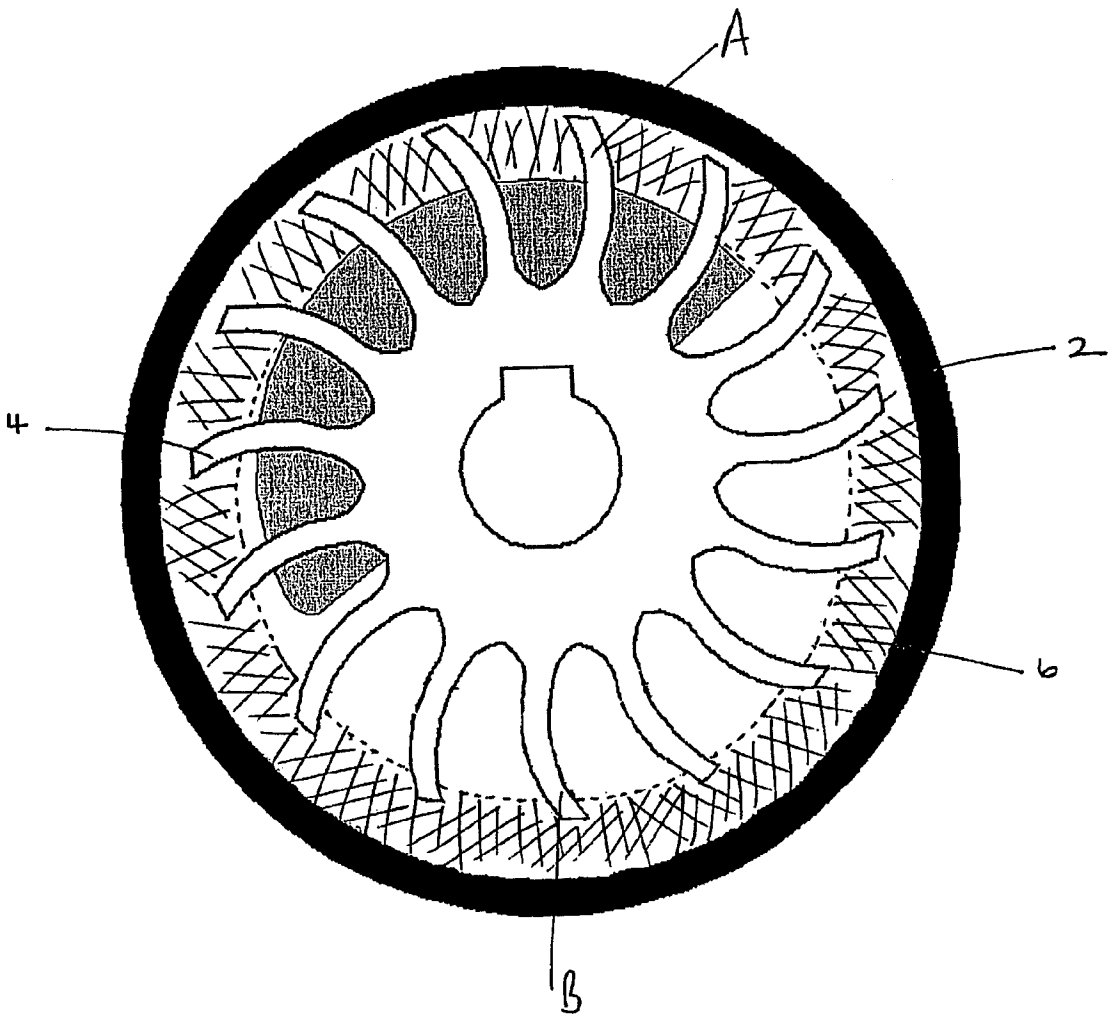
FIG. 2 depicts a cross-sectional view of a liquid ring vacuum pump in operation.
Figure 3:
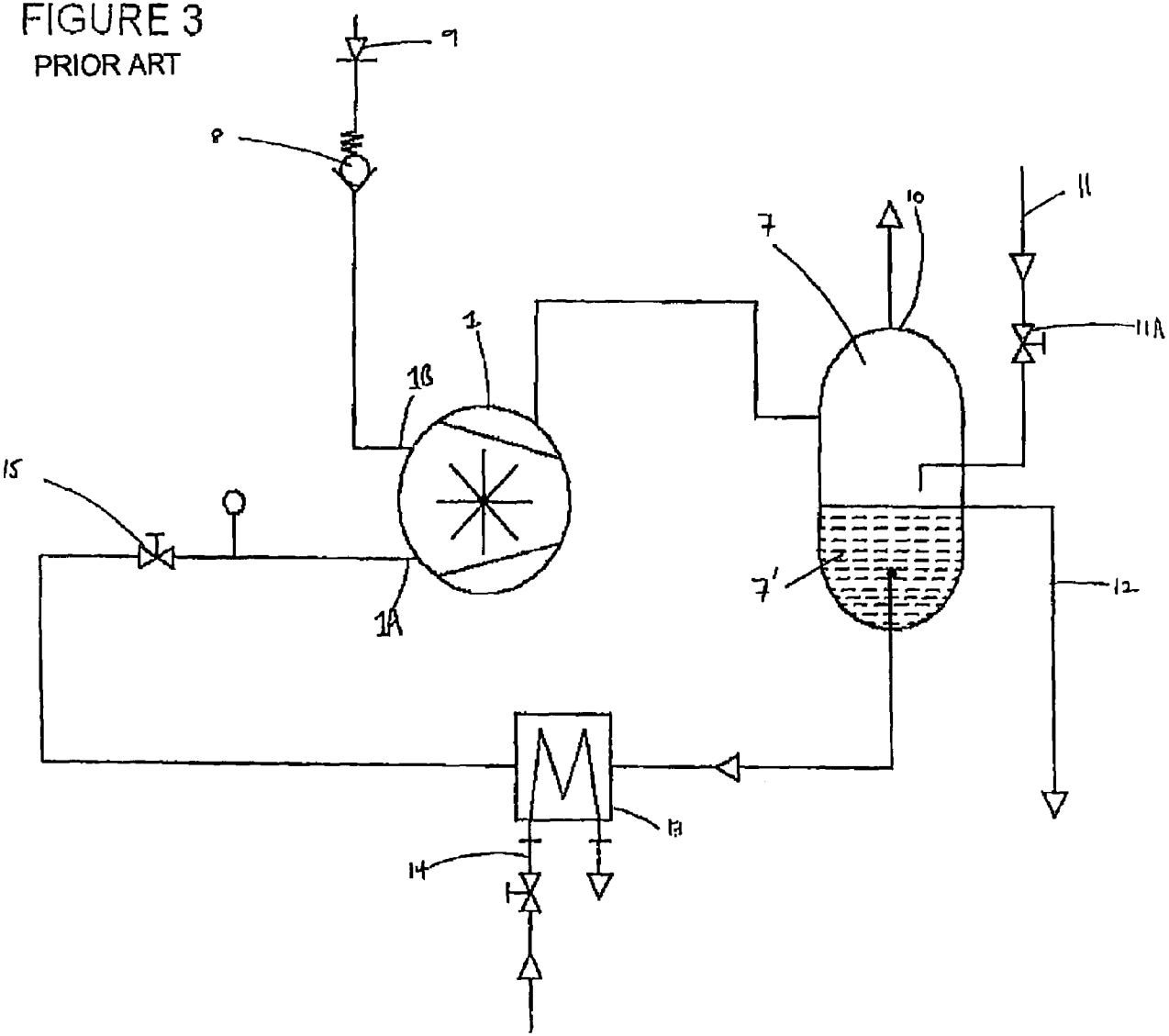
FIGURE 3 PRIOR ART
FIG. 3 depicts a prior art system for regulating the volume of barrier fluid in a liquid ring vacuum pump.
Figure 4:
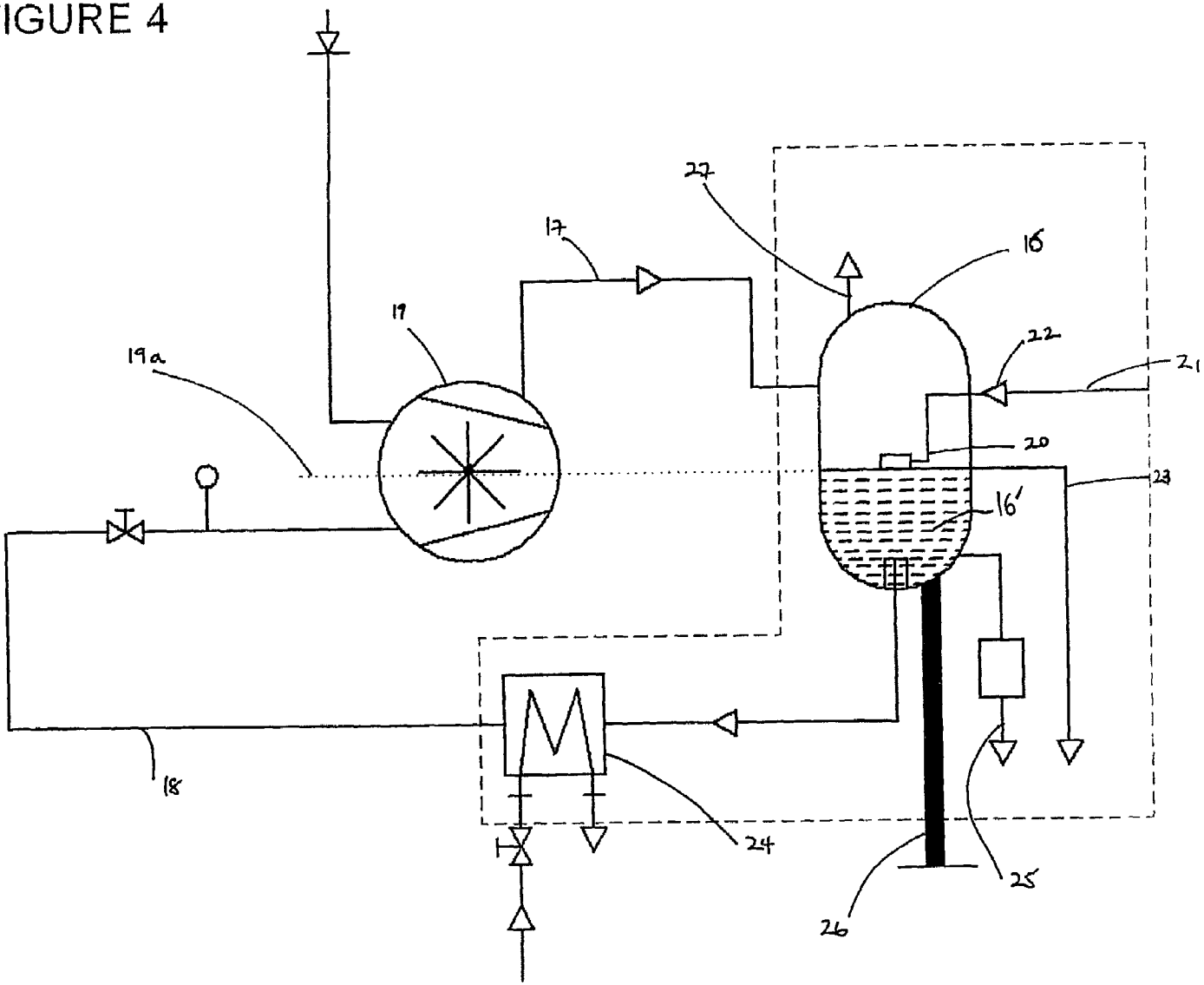
FIG. 4 depicts a simplified view of a system for regulating the volume of barrier fluid in a liquid ring vacuum pump in accordance with the present invention.
Figure 5:
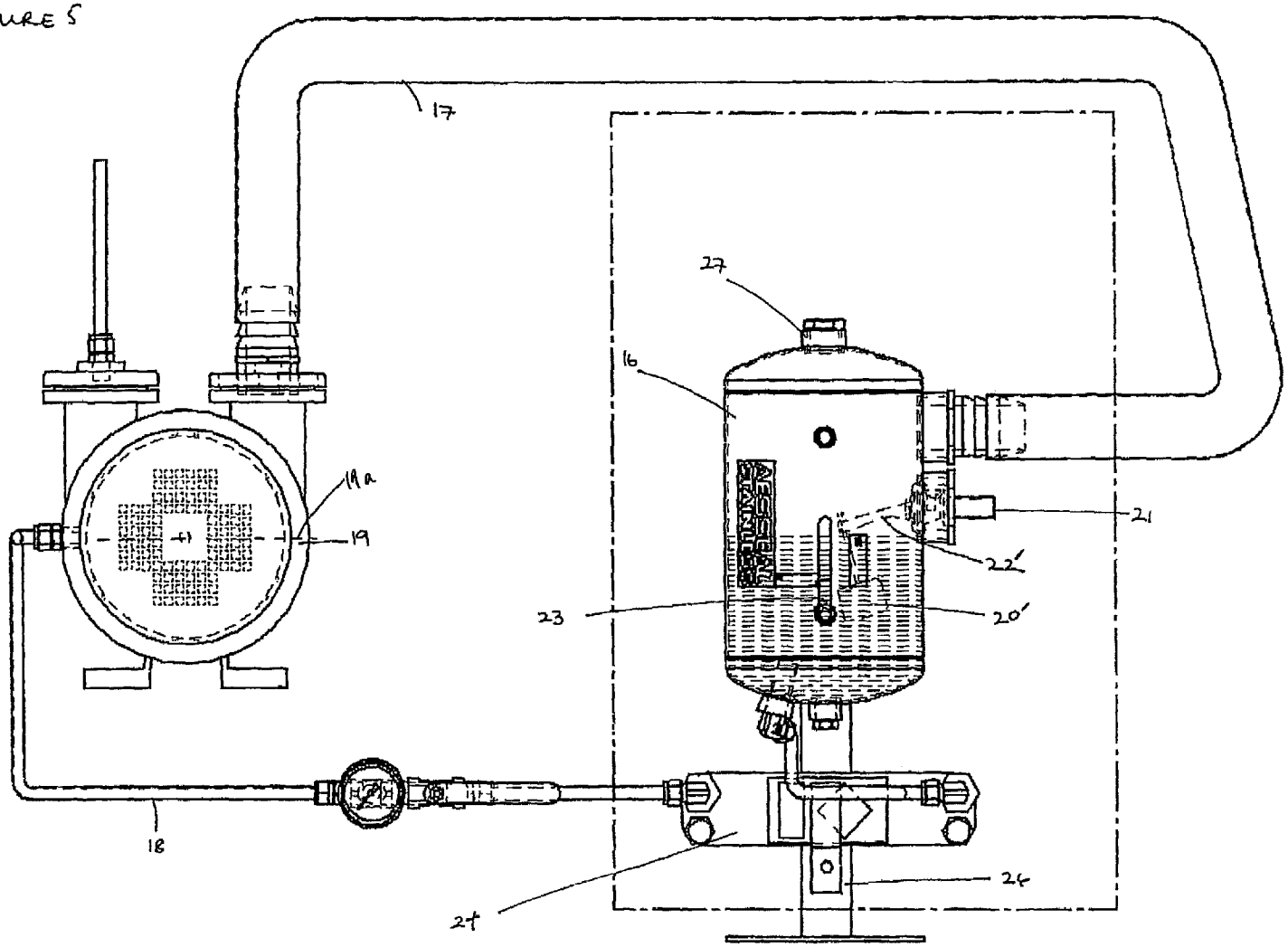
FIG. 5 depicts a cross-sectional view of the system in accordance with the present invention.
Figure 6:
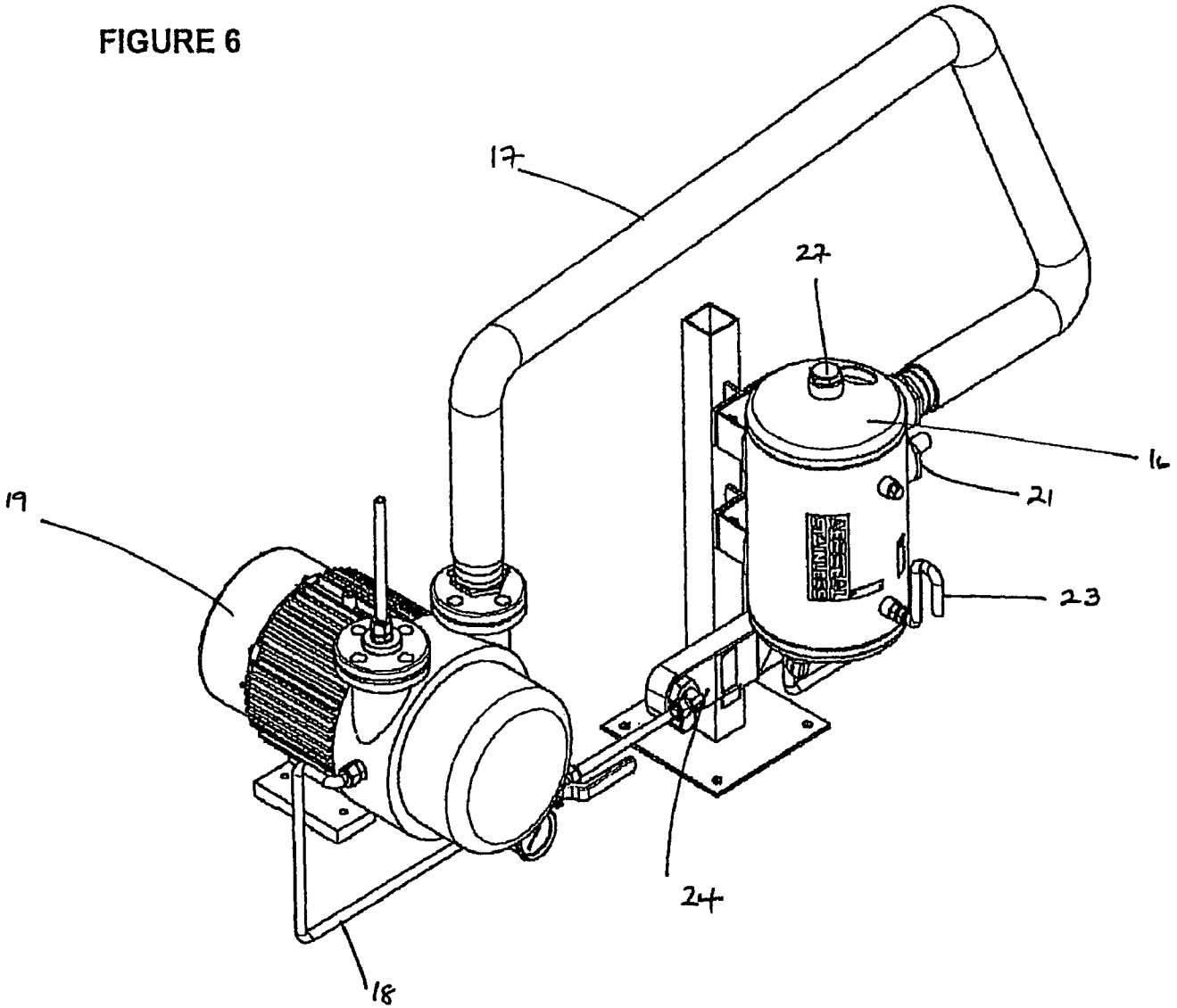
FIG. 6 depicts an isometric view of the system depicted in FIG. 5.

The system for regulating the volume of barrier fluid depicted in FIGS. 4, 5 and 6 comprises a vessel (16) which retains a quantity of barrier fluid (16'). The vessel (16) is connected to a liquid ring vacuum pump (19) by a feed pipe (17) and a return pipe (18) using the appropriate pipe connectors (not shown). A "loop" or "circuit" is formed such that barrier fluid is discharged from the pump (19) into the vessel (16) and drawn from the vessel (16) into the pump (19). The size of vessel (16) is selected in accordance with the size of pump (19), which in turn depends on the particular application in which the pump (19) is to be used, as will be understood by the person skilled in the art.

As noted above, any given liquid ring vacuum pump contain have an optimum amount of barrier fluid for optimum operation of the pump. The optimum amount of barrier fluid is conveniently determined by an optimum level of the barrier fluid in the pump when the pump us at rest. Typically, the optimum level is at, or about, the centre line of the pump.

The vessel (16) is arranged with respect to the pump (19) such that the level of the barrier fluid in the vessel (16) is indicative of the level of the barrier fluid in the pump (19) when the pump (19) is at rest. As will be readily apparent, with the pump at rest such that there is no significant pressure differential within the circuit defined by the vessel (16), pump (19) and feed lines (17), (18), the level of barrier fluid in the vessel (16) is necessarily the same as the level of the barrier fluid in the pump (19). Therefore the relative heights of the vessel (16) and the pump (19) are selected such that the level of the barrier fluid in the vessel (16)—when the barrier fluid is at its optimum level within the pump (19)—is at a convenient and predetermined point or level with respect to the height of the vessel (16). For example, the level of the barrier fluid within the vessel (16) may be selected to be substantially at the mid point of the vessel's height. Thus, in the case that the optimum level of barrier fluid in a given pump (19) is such that the barrier fluid level is at the centre line (19*a*) of the pump (19), then the height of the vessel (16) is adjusted or set so that the above predetermined point or level on the vessel (16) is level with the centre line of the pump (19*a*). In other words, when the pump (19) contains the optimum quantity of barrier fluid the level of the fluid in the vessel (16) is at the predetermined point, both levels being at the same height as the centre line (19*a*) of the pump (19). If the level of barrier fluid falls or rises in the pump then the level of barrier fluid in the vessel falls or rises by the same amount. Effectively, the level of barrier fluid in the vessel is used to indicate the volume of barrier fluid in the pump. If the barrier fluid in the vessel drops below the predetermined level defined on the vessel (typically, below the centre line of the pump) then the volume of barrier fluid in the pump is too low and if the barrier fluid level in the vessel rises above the predetermined level then the volume of barrier fluid in the pump is too high. The level of the barrier fluid in the vessel can be used to indicate the volume of barrier fluid in a working pump or stationary pump.

The system may include adjustable supports to adjust the position of the vessel relative to the pump.

The system includes means for detecting the level of barrier fluid within the vessel and in particular for determining when the level of barrier fluid in the vessel (16) departs from or varies with respect to the predetermined level. These means automatically detect the level of barrier fluid. The means for detecting the level of barrier fluid may be mechanical or electronic. The level of the barrier fluid may be detected using a float (20) that sits on the surface of the barrier fluid. The float is arranged such that it automatically moves up and down as the level of barrier fluid in the vessel (16) varies. The system may alternatively comprise a laser for measuring the level of the barrier fluid. In another alternative, the system may comprise electronic means using electrodes, probes or other suitable electrical or electronic fluid sensitive detecting means, to measure the barrier fluid level. Such measuring means are conveniently mounted vertically along the inside wall of the vessel.

The system comprises means for restoring the barrier fluid level in the vessel (16) to the predetermined level (the centre line of the pump). If the level of barrier fluid in the vessel (16) is restored then the level of barrier fluid in the pump (19) is also restored to the optimum level. Hence, the volume of barrier fluid in the pump (19) is regulated. The barrier fluid is automatically restored to the predetermined level within the vessel, and consequently the pump. The barrier fluid is automatically restored at the predetermined level within the vessel, and pump, in response to the level of fluid detected in the vessel.

The means for restoring the barrier fluid level comprises means for supplying barrier fluid from a barrier fluid source (not shown) to the vessel (16) when the level of barrier fluid drops below the predetermined level. FIGS. 4 and 5 show how the vessel is connected to inlet means (21) to supply barrier fluid from a barrier fluid source. If the barrier fluid is water, then the barrier fluid source is a main water system.

The means for restoring the barrier fluid level further include a valve (22) for controlling the flow of barrier fluid from the barrier fluid source. The valve (22) is arranged within the inlet means between the barrier fluid source and the vessel (16). The valve (22) is configured to automatically open and close in response to the detected barrier fluid level. If the barrier fluid level is detected as being below the predetermined level then the valve opens allowing barrier fluid to flow from the source into the vessel (16). Barrier fluid is subsequently allowed to flow back into the pump (19) and the valve (22) then closes when the barrier fluid levels in both the pump (19) and vessel reach the predetermined level. Obviously, the valve (22) remains closed if the detection means detect the barrier fluid level as being above the predetermined level. The valve (22) only re-opens if the barrier fluid level drops below the predetermined level. The means for detecting the level of barrier fluid and valve (22) are connected such that the valve (22) opens and closes in response to the detected barrier fluid level. The valve (22) may be a mechanical valve, for example a ball-cock mechanism (22'). FIG. 5 depicts an embodiment of the invention where the means for detecting the barrier fluid level is a float (20') connected to ball-cock type valve (22'). Alternatively, the valve may be electronically controlled, for example a solenoid valve. A solenoid valve may open and close in accordance with the fluid level detected by electrodes, probes etc.

The means for restoring the level of barrier fluid may also include means for discharging barrier fluid from the vessel when the level of barrier fluid exceeds the predetermined level. FIGS. 4 and 5 show the vessel being connected to outlet means (23) to discharge barrier fluid. The outlet means is arranged such that excess barrier fluid is discharged only when the barrier fluid level exceeds the predetermined level. Sufficient fluid is discharged until the barrier fluid levels in both the pump (19) and vessel (16) fall to the predetermined level. The outlet means may be a U-shaped tube. The discharged barrier fluid may be fed into the barrier fluid source so that it can be re-used.

The means for restoring the level of barrier fluid may further include a valve for controlling the flow of excess barrier fluid through the outlet means. The valve opens and closes in accordance with the detected barrier fluid level. The valve opens when the barrier fluid level rises above the predetermined level and closes when the barrier fluid level in the vessel, and consequently the pump, drops to or below the predetermined level. As with the valve (22) for controlling the flow of replenishing barrier fluid from the source, the valve for controlling the flow of excess barrier fluid may be a mechanical, electrical or an electronic valve. For example, the valve may be a ball-cock mechanism connected to a float-type fluid level detector or a solenoid valve electrically connected to an electrode-type fluid level detector.

There is no need for any user input once the system has been arranged and pre-set in accordance with the requirements of the liquid ring vacuum pump. Furthermore no periodic adjustments are required to control the volume of barrier fluid whilst the pump is operational. The system requires very little maintenance.

The means for automatically detecting the level of barrier fluid in the vessel and automatically restoring the barrier fluid level to a predetermined level provide an automatic and self-regulating system for liquid ring vacuum pumps. The system ensures that the level of the barrier liquid in the vessel, and thus pump, remains constant. The system automatically compensates for any variations in the volume of the barrier liquid. The system automatically compensates for leaks, evaporation, process upsets etc. Thus, the system for regulating the volume of barrier fluid is an intelligent system.

Heat is created within the pump as the evacuated fluid is compressed during the rotation of the impeller. The barrier fluid absorbs this heat. Therefore, the barrier fluid regulation system may include a heat exchanger to cool the barrier fluid prior to re-entering the pump. FIGS. 4, 5 and 6 depict a heat exchanger (24) arranged between the vessel and pump. The heat exchanger may be a compact heat exchanger or other suitable device. The heat exchanger cools the barrier fluid by directing the fluid through pipes that are cooled by cooling fluid. The cooling liquid circulates around the outside of the pipes. The flow and volume of cooling fluid within the heat exchanger may be regulated. The flow and volume of the cooling fluid may be regulated in order to maintain a constant temperature throughout the heat exchanger and/or to cool the barrier fluid sufficiently. The flow and volume of the cooling fluid may be adjusted using a valve. The valve may be a thermostatic valve that opens and closes in accordance with the temperature of the cooling fluid.

The vessel (16) of the barrier fluid regulation system may be connected to a second barrier fluid outlet that is controlled by a thermostatic valve. FIG. 4 depicts such a thermostatically controlled second barrier fluid outlet means (25). The valve may be programmed to open if the temperature of the barrier fluid reaches or exceeds a predetermined temperature. As a consequence, barrier fluid is directed through the outlet, the fluid level detection means (20) detect a drop in fluid level and the so the valve (22) controlling the flow of barrier fluid from the barrier fluid source opens until the barrier fluid reaches the predetermined level again. The barrier fluid from the source is generally cooler than the barrier fluid that has been discharged from the pump (19). Therefore, the removal of a warmer barrier fluid and addition of cooler barrier fluid allows the overall temperature of the barrier fluid in the vessel to drop. The thermostatic valve may be programmed to open until a sufficient quantity of warmer barrier fluid is discharged through the second outlet (25) and a sufficient quantity of cooler barrier fluid is added such that the overall temperature of the barrier fluid drops below the predetermined temperature. The valve may be programmed to open for predetermined lengths of time in accordance with the measured temperature of the barrier fluid. Hence, the valve may be programmed to open for a longer period of time if the temperature of the barrier fluid is particularly high. The thermostatically controlled valve may be programmed to work in conjunction with the heat exchanger. For example the thermostatic valve of this second outlet and thermostatic valve for the cooling fluid of the heat exchanger may be mutually pre-programmed and/or mutually controlled.

The barrier fluid regulation system may include a sediment trap (26) to remove any solid contamination from the barrier fluid and prevent the build up of solid contamination within the vessel. The removal of sedimentation from the barrier fluid also helps to minimise any damage to the pump.

The system may also comprise at least one vent to ensure the pressure within the vessel remains at atmospheric pressure. FIG. 4 depicts a vent (27) that is sized and arranged so that gases are released from the vessel in a controlled manner. The release of gas ensures the pressure within the vessel remains a constant.

The invention of claimed is:

1. A system for regulating the volume of barrier fluid in a liquid ring vacuum pump comprising:

a vessel for containing barrier fluid;

feeding means for feeding barrier fluid between the vessel and the pump, whereby the vessel is arranged with respect to a pump such that the level of barrier fluid in the vessel is indicative of the level of barrier fluid in the pump;

detecting means operative automatically to detect the level of barrier fluid in the vessel;

restoring means for automatically restoring the level of barrier fluid in the vessel, and consequently the pump, to a predetermined level if the level of barrier fluid detected by the detecting means does not correspond to the predetermined level; and at least one movable support to adjust the position of the vessel relative to the pump such that the level of barrier fluid in the vessel is indicative of the level of barrier fluid in the pump.

2. A system according to claim 1 wherein the restoring means comprises means for supplying barrier fluid from a barrier fluid source to the vessel when the barrier fluid level in the vessel is below the predetermined level.

3. A system according to claim 2 wherein the means for supplying barrier fluid comprise:

inlet means for feeding barrier fluid from the barrier fluid source to the vessel; and a valve for automatically controlling the supply of barrier fluid from the barier fluid source in response to the level of barrier fluid detected by the detecting means.

4. A system according to claim 3 wherein the detecting means and valve for controlling the supply of barrier fluid are interconnected mechanical devices.

5. A system according to claim 4 wherein the detecting means comprises a float and the valve for controlling the supply of barrier fluid comprises a ball-cock valve.

6. A system according to claim 3 wherein the detecting means and valve for controlling the supply of barrier fluid are interconnected electrical devices.

7. A system according to claim 1 wherein the means for restoring the level of barrier fluid includes means for discharging barrier fluid from the vessel when the barrier fluid level in the vessel exceeds the predetermined level.

8. A system according to claim 2 wherein the means for restoring the level of barrier fluid includes means for discharging barrier fluid from the vessel when the barrier fluid level in the vessel exceeds the predetermined level.

9. A system according to claim 7 wherein the means for discharging barrier fluid comprise outlet means for discharging barrier fluid from the vessel.

10. A system according to claim 9 wherein the means for discharging barrier fluid further comprises a valve for automatically controlling the discharge of barrier fluid through the outlet means in response to the level of barrier fluid detected by the detecting means.

11. A system according to claim 10 wherein the detecting means and valve for controlling the discharge of barrier fluid are interconnected mechanical devices.

12. A system according to claim 10 wherein the detecting means and valve for controlling the discharge of barrier fluid are interconnected electrical devices.

13. A system according to claim 1 further comprising a heat exchanger for cooling the barrier fluid.

14. A system according to claim 1 further comprising thermostatically controlled outlet means for discharging barrier fluid from the vessel when the temperature of the barrier fluid exceeds a predetermined temperature.

15. A system according to claim 1 further comprising a sediment trap for removing sediment from the barrier fluid.

16. A system according to claim 1 further comprising at least one vent for releasing gaseous fluids from the vessel.

17. A system for maintaining a desired quantity of barrier fluid in a liquid ring vacuum pump, comprising:

a vessel for containing barrier fluid;

at least one movable support to adjust the position of the vessel relative to the pump such that the level of barrier fluid in the vessel is indicative of the level of barrier fluid in the pump; and a barrier fluid flow path from the vessel to the pump and from the pump to the vessel; the vessel being arranged at a height with respect to the pump such that when the barrier fluid in the pump is at a predetermined optimum level corresponding to said desired quantity, the barrier fluid in the vessel is at a pre-selected level with respect to the vessel, the system further comprising:

a detector operative to detect when the level of the barrier fluid in the vessel differs from said pre-selected level; and restoring means operative to supply barrier fluid from a barrier fluid source to the vessel when the barrier fluid level in the vessel is determined to be less than the pre-selected level and to discharge barrier fluid from the vessel when the barrier fluid level in the vessel is determined to be greater than the pre-selected level.

18. A system for maintaining a desired quantity of barrier fluid in a liquid ring vacuum pump, comprising:

a liquid ring vacuum pump having an inlet port and an outlet port a vessel for containing barrier fluid, the vessel having an inlet port, an outlet port, a supply port operatively connected to a barrier fluid supply, a discharge port; a supply valve operable to control the supply of barrier fluid to the supply port and a discharge valve operable to control discharge of the barrier fluid through the discharge port; and a barrier fluid flow path from the outlet port of the vessel to the inlet port of the pump and from the outlet port of the pump to the inlet port of the vessel;

at least one movable support to adjust the position of the vessel relative to the pump such that the level of barrier fluid in the vessel is indicative of the level of barrier fluid in the pump;

the vessel being arranged at a height with respect to the pump such that when the barrier fluid in the pump is at a predetermined optimum level corresponding to said desired quantity, the barrier fluid in the vessel is at a pre-selected level with respect to the vessel, the system further comprising:

a detector operative to detect when the level of the barrier fluid in the vessel differs from said pre-selected level; and restoring means operative to cause the supply valve to open when the barrier fluid level in the vessel is determined to be less than the pre-selected level, thereby to supply barrier fluid to the vessel through the supply port, and to cause the discharge valve to open when the barrier fluid level in the vessel is determined to be greater than the pre-selected level thereby to discharge barrier fluid from the vessel through the discharge port.

19. A method of regulating the volume of barrier fluid in a liquid ring vacuum pump comprising the steps of:

providing a vessel for holding barrier fluid;

providing feeding means for feeding barrier fluid between a vessel and a pump;

arranging the vessel with respect to the pump using at least one movable support to adjust the position of the vessel relative to the pump such that the level of barrier fluid in the vessel is indicative of the level of barrier fluid in the pump;

automatically detecting the level of barrier fluid in the vessel; and automatically restoring the level of barrier fluid in the vessel, and consequently the pump, to a predetermined level if the detected level of barrier fluid does not correspond to the predetermined level.

20. A method of regulating the volume of barrier fluid in a liquid ring vacuum pump using a system, the system comprising:

a vessel for containing barrier fluid;

at least one movable support to adjust the position of the vessel relative to the pump such that the level of barrier fluid in the vessel is indicative of the level of barrier fluid in the pump;

feeding means for feeding barrier fluid between the vessel and the pump;

detecting means operative automatically to detect the level of barrier fluid in the vessel; and restoring means for automatically restoring the level of barrier fluid in the vessel, and consequently the pump, to a predetermined level if the level of barrier fluid detected by the detecting means does not correspond to the predetermined level;

the method comprising the steps of:

arranging the vessel with respect to the pump using the at least one movable support to adjust the position of the vessel relative to the pump such that the level of barrier fluid in the vessel is indicative of the level of barrier fluid in the pump;

automatically detecting the level of barrier fluid in the vessel; and automatically restoring the level of barrier fluid in the vessel, and consequently the pump, to a predetermined level if the detected level of barrier fluid does not correspond to the predetermined level.

21. A method of regulating the volume of barrier fluid in a liquid ring vacuum pump apparatus, the apparatus comprising:

a liquid ring vacuum pump;

a vessel for holding barrier fluid;

at least one movable support to adjust the position of the vessel relative to the pump such that the level of barrier fluid in the vessel is indicative of the level of barrier fluid in the pump;

feeding means for feeding barrier fluid between the vessel and pump, the method comprising the steps of:

arranging the vessel with respect to the pump using the at least one movable support to adjust the position of the vessel relative to the pump such that the level of barrier fluid in the vessel is indicative of the level of barrier fluid in the pump;

automatically detecting the level of barrier fluid in the vessel; and automatically restoring the level of barrier fluid in the vessel, and consequently the pump, to a predetermined level if the detected level of barrier fluid does not correspond to the predetermined level.

22. A method according to claim 19 further comprising the method step of:

supplying barrier fluid from a barrier fluid source to the vessel when the barrier fluid level in the vessel is below the predetermined level.

23. A method according to claim 21 further comprising the method step of:

supplying barrier fluid from a barrier fluid source to the vessel when the barrier fluid level in the vessel is below the predetermined level.

24. A method according to claim 22 further comprising the method step of:

automatically controlling the supply of barrier fluid from the barrier fluid source in response to the detected level of barrier fluid.

25. A method according to claim 19 further comprising the method step of:

discharging barrier fluid from the vessel when the barrier fluid level in the vessel exceeds the predetermined level.

26. A method according to claim 21 further comprising the method step of:

discharging barrier fluid from the vessel when the barrier fluid level in the vessel exceeds the predetermined level.

27. A method according to claim 25 further comprising the method step of:

automatically controlling the discharging of barrier fluid from the vessel in response to the detected level of barrier fluid.

28. A method according to claim 19 further comprising the method step of:

cooling the barrier fluid.

29. A method according to claim 21 further comprising the method step of:

cooling the barrier fluid.

30. A method according to claim 19 further comprising the method steps of:

detecting the temperature of the barrier fluid in the vessel;

discharging barrier fluid from the vessel if the temperature of the barrier fluid exceeds a predetermined temperature; and supplying barrier fluid from the barrier fluid source until the temperature of the barrier fluid in the vessel corresponds to or is below the predetermined temperature.

31. A method according to claim 21 further comprising the method steps of:

detecting the temperature of the barrier fluid in the vessel;

discharging barrier fluid from the vessel if the temperature of the barrier fluid exceeds a predetermined temperature; and supplying barrier fluid from the barrier fluid source until the temperature of the barrier fluid in the vessel corresponds to or is below the predetermined temperature.

* * * * *